US005603645A

United States Patent [19]

Saccomanno

[11] Patent Number: 5,603,645

[45] Date of Patent: Feb. 18, 1997

[54] PRONE SURF BOARD CONSTRUCTION

[76] Inventor: Tom F. Saccomanno, 41 Kimo Pl., Hilo, Hi. 96720

[21] Appl. No.: 266,333

[22] Filed: Jul. 1, 1994

[51] Int. Cl.[6] ..... B63B 1/00

[52] U.S. Cl. ..... 441/65; 441/75

[58] Field of Search ..... 441/65, 74, 75; 280/18; D21/228

[56] References Cited

U.S. PATENT DOCUMENTS

| | | | |
|---|---|---|---|
| 1,028,601 | 4/1912 | Simpson | 441/65 |
| 4,439,165 | 3/1984 | Rothstein | 441/65 |
| 4,619,619 | 10/1986 | Muse, Jr. | 441/79 |
| 4,708,675 | 11/1987 | Shoeffler et al. | 441/65 |
| 4,929,207 | 5/1990 | Piatt | 441/65 |
| 5,163,860 | 11/1992 | Clark | 441/65 |

*Primary Examiner*—Jesus D. Sotelo
*Attorney, Agent, or Firm*—Terrance L. Siemens

[57] ABSTRACT

A wave surfing board, for use by a rider in prone stomach-down position, is formed of smooth fiberglass which accelerates on the waves far better than a lighter foam body board. The board is provided with a stiff rope handle anchored on or otherwise suitably secured to the upper surface of the board proximate the forward nose of the board. The location of the stiff rope handle is such that it can be easily reached and grasped by the surfer. The stiff rope handle provides a firm grip for one hand of the prone surfer, the firm grip being crucial for maneuvers which are quick and controlled. The under surface of the board is provided, proximate the trailing end, with a plurality of downwardly extending fins which provide stability for the rear of the board in the waves.

3 Claims, 1 Drawing Sheet

PRONE SURF BOARD CONSTRUCTION

BACKGROUND OF THE INVENTION

1. Field of the Invention

The present invention relates to surfing devices, and more particularly to a prone surfing device of the type known in the art as a "Bull Board". Surfing is the art of riding upon waves of water, usually in the ocean. Surfing is a popular recreation pastime as well as a recognized competitive sport. In accordance with conventional terminology and throughout the remainder of this specification, the invention will merely be referred to as a board for simplicity.

The board of the present invention provides a new concept in wave riding which may be referred to as "Bull Boarding" and which is a high-tech form of prone surfing. In "Bull Boarding" one of the surfer's hands is free to play the waves while the other hand grasps a rope handle (to be described) to steer and to hold onto the board.

2. Description of the Prior Art

Devices for riding the waves are old and well known in the art. Many such devices have been developed for riding the waves in a standing or kneeling position. Recently, boards for riding in a prone position have been developed. In accordance with conventional terminology, the term prone used herein may be taken to mean front or belly surface down. A consistent problem with this type of surfing has been that the relatively immobile position of the body leaves little maneuverability to exert control or steering forces to the board. The following known prior art has been directed to providing surfing control. As will be seen, the simplicity and effectiveness of my invention is not rivaled in the prior art.

U.S. Pat. No. 4,894,034 issued to Russell S. Brown III on Jan. 16, 1990, shows a foam bodyboard in which the surfer or rider reclines stomach-down against the riding surface with his front arm extending forwardly for gripping the nose of the bodyboard and his opposite arm positioned in a trailing manner for gripping the side edge. Brown, III provides hand-hold means defined by contoured surfaces of the bodyboard for the purpose of orienting and maintaining the surfer's hand in a predetermined position relative to the length of the bodyboard. By contrast, the instant invention is formed of fiberglass which accelerates on the waves far better than a lighter foam body board. In addition, a semi-rigid rope handle is anchored near the front center of the instant invention to provide a firm grip for one hand of the prone surfer. The firm grip provided by the rope handle of the present invention is crucial for maneuvers which are quick and controlled.

U.S. Pat. No. 3,593,856, issued to Schmalfeldt on Jul. 20, 1971, shows a surfboard control device comprising a foot stirrup which holds one of the feet of the surfer on the surfboard during surfing. By contrast the feet of the surfer are not on the board of the instant invention.

U. S. Pat. No. 4,571,195, issued to Brooks, Jr. on Nov. 3, 1983, shows a recreational device which may be employed by a user in a standing, sitting, or prone position. The patent shows no protruding rope handle as in the instant invention.

U. S. Pat. No. 4,592,734, issued to Metiver, on May 31, 1985, shows a foot strap, unsuitable for hand gripping, for use with surfboards. By contrast, the present invention is not intended for foot contact.

U. S. Pat. No. 4,929,208, issued to Corica on Apr. 7, 1989, shows a surfboard with a longitudinally oriented handgrip for use by a surfer in a standing position. The patent to Corica also shows in FIG. 1 two unnumbered fins projecting from the under surface of the surfboard near the trailing end of the surfboard. By contrast, the board of this invention is designed for use in a prone position and the shorter handgrip is oriented transversely.

U. S. Pat. No. 4,990,113 issued to Morrison on Feb. 5, 1991, shows a surfboard having an angled hand grip for use in doing aerobic maneuvers on the surfboard while in a standing position. The hand grip of Morrison is located near the rear of the board. By contrast, the hand grip of applicant's board is located near the front of the board, and is transversely oriented.

It will be noted that all the prior art devices require a standing position for control and none address the problem of control while in a prone position.

None of the above inventions and patents, taken either singly or in combination, is seen to describe the instant invention as claimed.

SUMMARY OF THE INVENTION

Briefly, the invention comprises a smooth rounded end fiberglass board with a short, stiff, transverse rope near the front end for gripping control. The rope is embedded in the fiberglass for durability and attractive appearance.

Accordingly, it is a principal object of the invention to provide a new and improved prone surf board construction which overcomes the disadvantages of the prior art in a simple but effective manner.

It is an object of the present invention to provide a board type of surfing device which is ideally suited for use in prone surfing, in which the rider lies in a prone, stomach-down position.

It is another object of the invention to provide a board type of surfing device made of fiberglass which accelerates on the waves far better than a lighter foam body board.

It is a further object of the invention to provide a board type of surfing device having a handle which is not only a steering device but which gives the rider something to hold onto while ducking through the waves or while being thrown by the waves.

It is still a further object of the invention to provide a board type of surfing device having a stiff, substantially rigid, handle which is adapted to be grasped by a rider for stability and control.

It is still another object of the invention to provide a board type of surfing device having a stiff poly-rope (multi-strand) handle positioned on the upper surface of the board and located proximate the forward nose, and which handle may be grasped for maneuvers which are quick and controlled.

It is another object of the present invention to provide a board type of surfing device having a rigid poly-rope (multi-strand) handle which is laterally oriented so that it can be easily reached and easily held by the user.

In achievement of these objectives, there is provided a new type of surfing device which is intended to be used with a rider in a prone stomach-down position. An important feature of the board is the fact that it is formed of fiberglass which accelerates on the waves far better than a lighter foam body board. A further important feature of the Board construction is the provision of a rigid poly-rope (multi-strand) handle anchored laterally on the upper surface proximate the forward nose of the Board. The stiff poly-rope (multi-strand) handle provides a firm grip for one hand of the prone surfer. The under surface of the Board is provided at the trailing end thereof with a plurality of fins which provide stability for the Board in the wave or "swells" of the wave.

Finally, it is a general goal of the invention to provide improved elements and arrangements thereof in an apparatus for the purposes described which is inexpensive, dependable and fully effective in accomplishing its intended purposes.

The present invention meets or exceeds all the above objects and goals. Upon further study of the specification and appended claims, further objects and advantages of this invention will become apparent to those skilled in the art.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
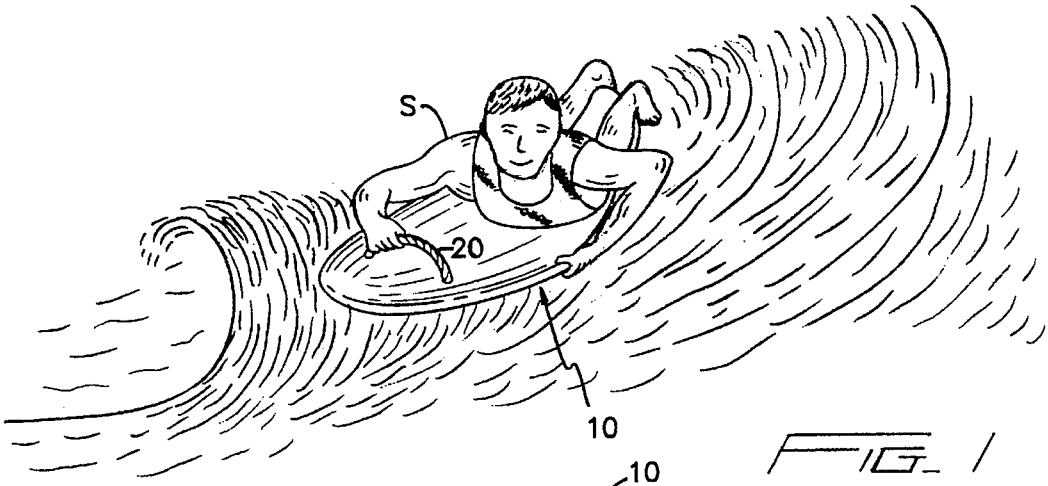
FIG. 1 is an environmental perspective view showing the board of the invention in use.
Figure 2:
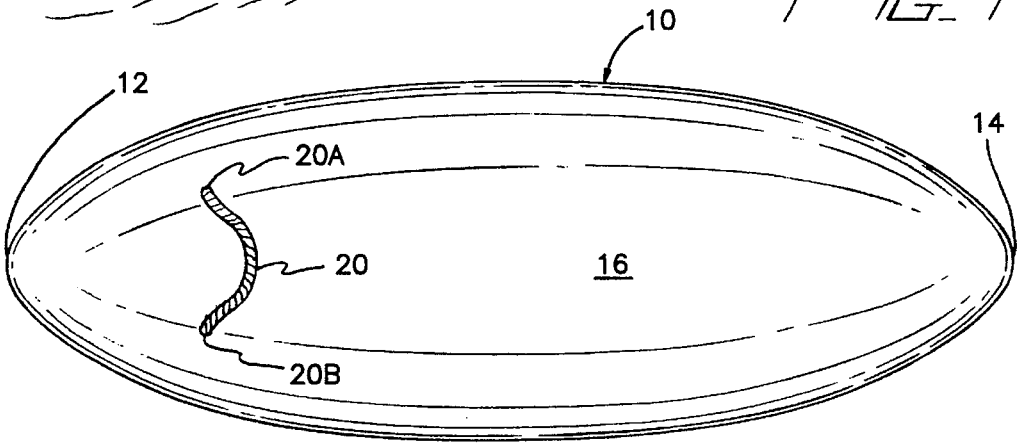
FIG. 2 is a top plan view showing the board of FIG. 1 showing particularly the curved nose and trailing ends of the board and the positioning of the unique rope handle.
Figure 3:
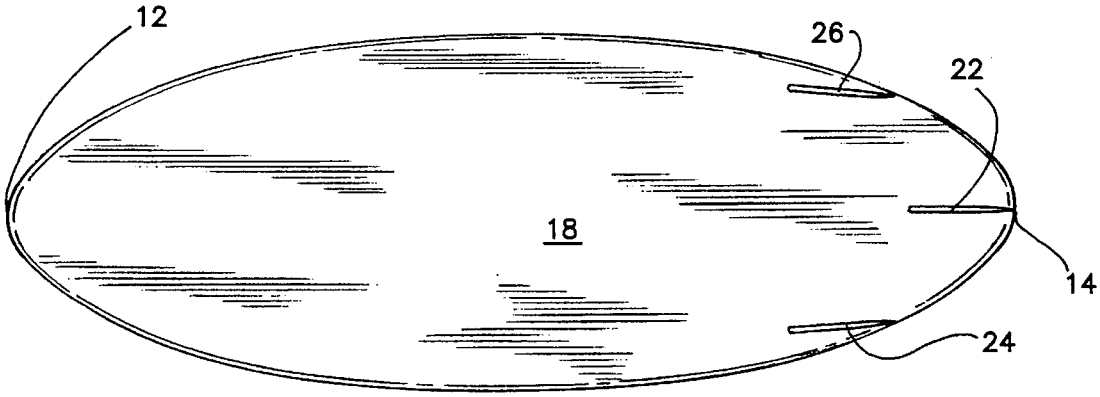
FIG. 3 is a bottom plan view of the board of FIGS. 1 and 2 showing particularly the positioning of the lower fins.
Figure 4:
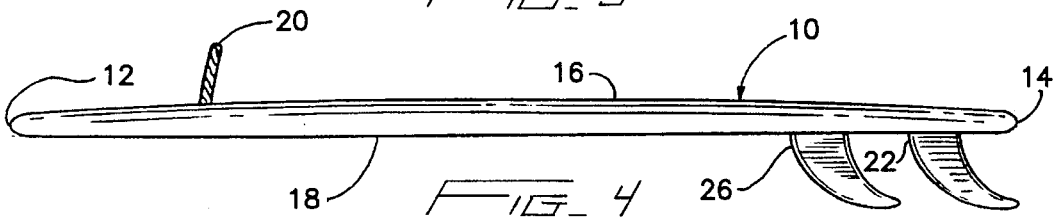
FIG. 4 is a side elevation view of the board of FIGS. 1, 2, and 3 showing the downward extension of the fins and the upward extension of the rope handle.

Referring now to the figures, there is shown in FIG. 1 a surfer S lying in a prone position on the upper surface of a board generally indicated at 10. The details of board 10 are shown in FIGS. 2, 3 and 4. Board 10 is covered with smooth fiberglass which accelerates on the waves far better than lighter foam body boards. The slight additional weight provides a greater force component, parallel to the wave surface, with respect to the oppositely directed drag force of the water. In addition the smooth surface provides a lower drag force.

Board 10 is shorter in length than surfboards intended for use by a surfer in standing position such as the surfboard shown in the above U.S. Pat. No. 4,929,208 to Corica, but is longer than a surfing device of the bodyboard type, such as shown by U.S. Pat. No. 4,894,034 to Brown, III.

Board 10 is provided at its leading end with a rounded nose 12 and at its trailing end with a rounded nose 14. Board 10 includes an upper surface 16, best seen in FIGS. 1, 2 and 4, and a lower surface 18, best seen in FIGS. 3 and 4.

An important feature of the board construction, shown in all the figures, is the stiff handle 20 having opposite ends 20A, 20B. The preferred handle 20 is made of poly-rope with multiple braided strands and has a diameter sufficient to provide a comfortable grip without cutting the hands. Handle 20 is quite stiff and may be treated to increase its stiffness if desired. Opposite ends 20A and 20B of handle 20 are firmly imbedded into upper surface 16 of fiberglass board 10. Other forms of attachment could be used, but it is preferred that a rope handle 20 be molded into the board when it is originally formed.

Handle 20 extends laterally and perpendicular to the longitudinal center line of the board near leading end rounded nose 12. The lateral orientation and forward positioning of the handle is an important feature of the invention in that it allows for easy gripping with either or both hands from the prone position without precise prepositioning of the hands. While surfing the waves, a firm grip must often be made rapidly and firmly. There is no time to grope for the handle with either hand.

Handle 20 is relatively short being formed so that its maximum height above the board is less than the distance between attached ends 20A and 20B. This short length is important because of the required stiffness needed to pass quick impulsive hand forces through to the board.

As best seen in FIGS. 3 and 4, board 10 is provided, proximate the normally trailing end thereof, with fins 22, 24 and 26 which project downwardly from the under surface of board 10. Central fin 22 is substantially aligned with the longitudinal axis of board 10, while side fins 24 and 26 extend generally parallel to central fin 22 on opposite sides of the longitudinal axis of board 10. Fins 24 and 26 are not precisely parallel to central fin 22, but are tapered inwardly toward the rear at a shallow angle. This slight inward taper tends to funnel water passing beneath board 10 toward the center as it exits toward the rear. This, in turn, leads to improved directional stability.

Fins 22, 24, 26, provide both lateral and directional stability during the wave ride. Fins 22, 24, 26 may be integral with the fiberglass board or, alternatively, may be suitably secured to board 10.

In operation, the rider or surfer rides the waves on board 10 in a prone stomach-down position, as best seen in the view of FIG. 1, with his hand or hands grasping the rope handle 20 for stability and control. Preferably, one of the surfer's hands is free to play the waves while the other hand of the surfer grasps the rope handle 20. Steering may be accomplished simply by grasping and tugging the rope or by arching the back and rotating the board about a vertical axis through the abdomen by jerking on the rope handle.

The stiff rope handle 20 is not only a steering device for the board but also gives the rider something to hold onto while ducking through waves or being thrown from them. Another purpose of using a stiff rope for handle 20 is that it provides a hold which is rigid and firmly fixed in case the rider is washed off the board. The stiff rope handle 20 is centered approximately one foot from nose 12 of board 10. whereby handle 20 provides a firm grip, crucial for maneuvers which are quick and controlled.

From the foregoing detailed description of the invention, it has been shown how the objects of the invention have been obtained in a preferred manner. However, modification and equivalents of the disclosed concepts as readily occur to those skilled in the art are intended to be included within the scope of this invention.

It is to be understood that the provided illustrative examples are by no means exhaustive of the many possible uses for my invention.

From the foregoing description, one skilled in the art can easily ascertain the essential characteristics of this invention and, without departing from the spirit and scope thereof, can make various changes and modifications of the invention to adapt it to various usages and conditions. For example, the artisan could ascertain easily a variety of clamps or other conventional means for attaching the ends of rope handle 20 board 10. Also it would be obvious to use other forms of handles such as molded plastic or aluminum tubing.

It is to be understood that the present invention is not limited to the sole embodiment described above, but encompasses any and all embodiments within the scope of the following claims:

I claim:

1. A surfing device for riding on a wave by a rider in prone stomach-down position comprising;

relatively flat board member with an outer surface of smooth fiberglass and having smooth upper and lower surfaces, a length dimension defining a longitudinal axis, and a width dimension, said flat board member also having a rounded nose, a rounded tail, and lateral sides providing a gently curved transition between said rounded nose and said rounded tail such that said gently curved transition lacks a discernible corner;

a rope steering handle member for enabling manual steering of said surfing device, said handle member attached to said board member at two points along the top surface of said board member, said two points located on a line normal to said longitudinal axis, and said two points located inside said lateral sides such that a margin having a dimension of at least fifteen percent of the maximum width dimension of said board member exists between each one of said two points of attachment and the nearest said lateral side, and said line located behind said rounded nose by a margin of less than fifteen percent of said length dimension wherein said rope handle member is a stiff rope with two ends integrally secured to said board member by molding both ends of said rope into said fiberglass, and said smooth upper surface is interrupted only by said stiff rope extending above said board member;

a plurality of fins permanently attached to and projecting downwardly from the smooth lower side of said board member at an end proximate said rounded tail wherein said smooth lower side of said board member is interrupted only by said fins.

2. The surfing device according to claim 1, said plurality of fins including two side fins located on a line perpendicular to said longitudinal axis, and spaced apart from said longitudinal axis, and a third fin located on said longitudinal axis behind said two fins wherein;

said side fins are tapered slightly toward said central longitudinal axis to provide oppositely directed side thrusts so as to enhance directional stability as said board member as it rides the wave.

3. A surfing device as defined in claim 1, in which said rope handle member extends to a maximum height above the board of less than the distance between said two ends of said rope.

* * * * *